United States Patent [19]

Adachi et al.

[11] Patent Number: 4,639,123

[45] Date of Patent: Jan. 27, 1987

[54] CLEANING DEVICE

[75] Inventors: Hiroyuki Adachi, Hachioji; Takashi Saito, Ichikawa, both of Japan

[73] Assignee: Canon Kabushiki Kaisha, Tokyo, Japan

[21] Appl. No.: 569,023

[22] Filed: Jan. 9, 1984

[30] Foreign Application Priority Data

Jan. 11, 1983 [JP] Japan ..... 58-2633

[51] Int. Cl.[4] ..... G03G 21/00

[52] U.S. Cl. ..... 355/15; 118/652; 15/256.51

[58] Field of Search ..... 355/15; 15/1.5, 256.5, 15/256.51, 256.52; 118/652

[56] References Cited

U.S. PATENT DOCUMENTS 3,552,850 1/1971 Royka et al. ..... 15/1.5 X

FOREIGN PATENT DOCUMENTS 44-2034 1/1969 Japan .

*Primary Examiner*—R. L. Moses

*Attorney, Agent, or Firm*—Fitzpatrick, Cella, Harper & Scinto

[57] ABSTRACT

This specification discloses a cleaning device for removing a developer and dust adhering to a surface to be cleaned in an image forming apparatus. More specifically, the specification discloses a cleaning device characterized in that an elastic cleaning member bears against the surface to be cleaned in opposed relationship with the direction of movement of the surface to be cleaned and portion of the cleaning member which bears against the surface to be cleaned is of a small thickness which lessens the contact pressure force thereof relative to the surface to be cleaned which tends to be increased by reduction in the free length from the held portion of the cleaning member to the portion of the cleaning member which bears against the surface to be cleaned.

10 Claims, 10 Drawing Figures

CLEANING DEVICE

BACKGROUND OF THE INVENTION

1. Field of the Invention

This invention relates to a cleaning device for removing a developer and dust adhering to a surface to be cleaned in an image forming apparatus. More particularly, the invention relates to a cleaning device which is made compact by shortening the length from the held portion of a cleaning member to the portion of the cleaning member which bears against the surface to be cleaned and in which the cleaning member can bear against the surface to be cleaned with a good contact pressure force. The image forming apparatus may be an electrophotographic copying apparatus, a micro instrument, a recording apparatus or the like. The surface to be cleaned may be the surface of a member to which a developer adheres, such as an image bearing member such as a photosensitive drum or a magnetic drum or a fixing roller.

2. Description of the Prior Art

FIGS. 1 and 2 of the accompanying drawings show examples of the cleaning device according to the prior art. Both of the cleaning devices of FIGS. 1 and 2 are for removing toner from the surface of the photosensitive medium of an electrophotographic copying apparatus by the use of a blade.

In the example shown in FIG. 1, a rectangular elastic blade 2 bears against a photosensitive medium 1*a* along the direction of movement thereof (the direction of arrow a). In this case, the combined drag R of a vertical drag N which the blade 2 receives from the photosensitive medium 1*a* and the friction force F between the photosensitive medium 1*a* and the blade 2 acts in a direction to pull the blade 2 away from the photosensitive medium 1*a*. Therefore, the force which blocks toner is weak and very often, toner particles collect beneath the blade and when toner particles collect at one location, they tend to readily extend over the full length of the blade, and this has often led to the necessity of removing the blade and cleaning the tip end edge portion thereof.

For this reason, in the example shown in FIG. 2, a rectangular elastic blade 2 is caused to bear against a photosensitive medium 1*a* in opposed relationship with the direction of movement thereof (the direction of arrow b). In this example, cleaning is effected at the obtuse angle side whereat the blade 2 intersects the photosensitive medium 1*a*. Thus, part of the combined drag R is stored as the elastic strain of the blade and all the remainder of the combined drag R acts as an effective cleaning force, and the blade 2 is pushed into the wedge-shaped space between a holder 3 and the photosensitive medium 1*a*, i.e., in the direction of the friction force F, so that the toner blocking capability is remarkably greater than in the example of FIG. 1 and accordingly, toner particles hardly collect beneath the blade and can be removed sufficiently. If, in this manner, the blade 2 bears against the photosensitive medium 1*a* in opposed relationship with the direction of movement thereof, the cleaning performance will be enhanced. However, the direction of the friction force F is the direction in which the blade 2 is reversed. Thus, to prevent such reversal phenomenon, the blade 2 must have a thickness greater than a predetermined thickness or a free length greater than a predetermined free length, and this has formed an obstacle in making the cleaning device compact. That is, an attempt to shorten the free length of the blade would result in an increased contact pressure force of the blade relative to the photosensitive medium, which in turn would lead to the increased danger of the photosensitive medium being damaged. As a countermeasure for this, it would occur to mind to decrease the thickness of the elastic blade, but in such case, the holding force in the held portion of the blade would not be dispersed uniformly and the deformation of the blade would become great during application of a pressure, and this has led to the possibility of the cleaning performance being reduced. That is, the free end of the blade 2 relative to the holder 3 is on a line P and, where the thickness of the blade 2 is constant, the stress of displacement of the blade 2 concentrates on points $Q_1$ and $Q_2$ and the blade 2 is liable to be displaced from these portions and thus, reversal of the blade is also liable to occur in these portions.

SUMMARY OF THE INVENTION

It is an object of the present invention to provide a compact cleaning device.

It is another object of the present invention to provide a cleaning device in which the length from the held portion of a cleaning member to the portion of the cleaning member which bears against a surface to be cleaned is shortened.

It is still another object of the present invention to provide a cleaning device in which the length from the held portion of the cleaning member to the portion of the cleaning member which bears against the surface to be cleaned is shortened and yet the cleaning member bears against the surface to be cleaned with a good contact pressure force.

It is yet still another object of the present invention to provide a cleaning device which permits the selection range of the material of the cleaning member to be widened.

The invention will become fully apprarent from the following detailed description thereof taken in conjunction with the accompanying drawings.

DETAILED DESCRIPTION OF THE PREFERRED EMBODIMENTS

The present invention will hereinafter be described in more detail with respect to some embodiments thereof.

Figure 3:
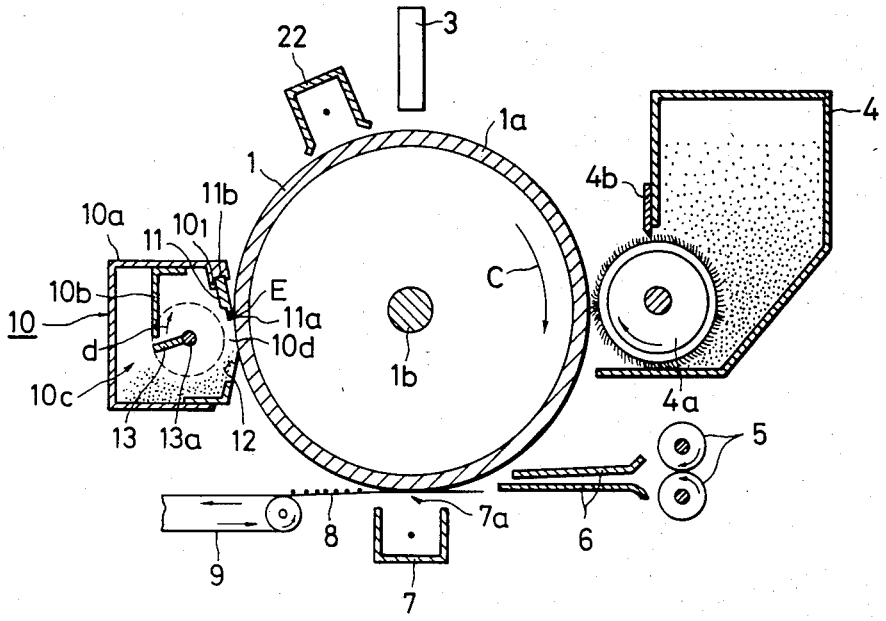
FIG. 3 is a cross-sectional view showing the essential portions of an electrophotographic copying apparatus to which the present invention is applicable.

FIG. 3 illustrates the essential portions of an electrophotographic copying apparatus to which a cleaning device according to an embodiment of the present invention is applied. In FIG. 3, reference numeral 1 designates an image bearing member comprising, for example, a drum-shaped photosensitive medium 1*a* having a photoconductive substance such as Se or OPC. This drum-shaped image bearing member 1 is supported on a shaft 1*b* and rotatable in the direction of arrow C. Reference numeral 22 denotes a corona discharger for uniformly charging the surface of the photosensitive medium 1*a*. Reference numeral 3 designates optical means such as a short focus optical element array for applying onto the photosensitive medium 1*a* an optical image corresponding to the image of an original. Reference numeral 4 denotes a developing device for developing an electrostatic latent image formed on the photosensitive medium 1*a* in conformity with the applied optical image. Reference numeral 4*a* designates a magnet roller, and reference numeral 4*b* denotes a scraper for controlling the erection of developer on the roller 4*a*. Reference numeral 5 designates a pair of timing rollers which serve to feed a transfer medium 8 fed from paper supply means, not shown, to an image transfer station in synchronism with the developed image on the photosensitive medium 1*a*. Reference numeral 6 denotes a transfer medium guide, and reference numeral 7 designates a transfer corona discharger for applying transfer corona to the back of the transfer medium 8 and thereby accomplishing the transfer of the developed image to the transfer medium 8 fed to the transfer station 7*a*. Designated by 9 is a conveyor belt for conveying the transfer medium to fixing means, not shown, after completion of the image transfer. Denoted by 10 is a cleaning device according to an embodiment of the present invention. Reference numeral 11 designates a cleaning blade to which an embodiment of the present invention is applied, the cleaning blade 11 being formed of an elastic material such as urethane rubber or plastics. The fore end portion 11*a* of the cleaning blade 11 which bears against the photosensitive medium 1*a* is made thin. The rear end 11*b* of the blade 11 is adhesively held to a blade holder portion $\mathbf{10}_1$ provided in a cleaning housing 10*a*. Reference numeral 12 designates an elastic guide sheet which is in light contact with the surface of the photosensitive medium 1*a* so as to permit passage of any toner remaining on the photosensitive medium 1*a* and permit the toner scraped off the photosensitive medium 1*a* by the blade 11 to be directed away from the photosensitive medium 1*a*. Reference numeral 13 denotes a rotary vane which is supported on a rotary shaft 13*a* and may be rotated in the direction of arrow d to thereby cause the toner scraped off the surface of the photosensitive medium 1*a* by the blade 11 to be directed to the inner part 10*c* of a partition wall 10*b*. The cleaning housing 10*a* has an opening 10*d* in the side thereof which is opposed to the photosensitive medium 1*a*, in order that the toner scraped off by the blade 11 may be received into the cleaning housing without scattering.

Figure 4:
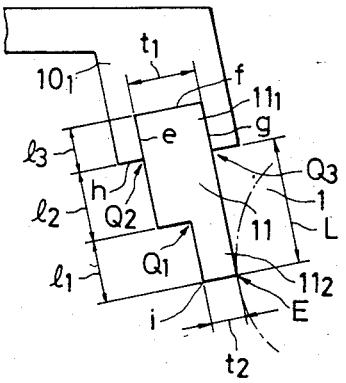
FIG. 4 is a side view of a cleaning blade to which an embodiment of the present invention is applied.

Now, FIG. 4 is an enlarged side view of the cleaning blade portion.

Figure 1:
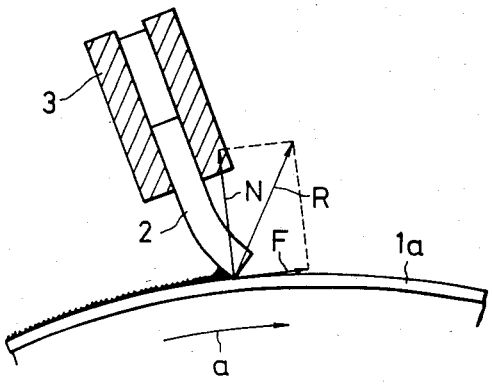
FIG. 1 PRIOR ART
FIGS. 1 and 2 are cross-sectional views showing the cleaning blades according to the prior art.
Figure 2:
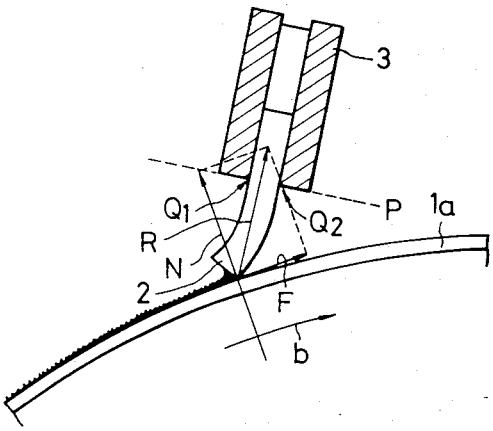
FIG. 2 PRIOR ART

This cleaning blade 11 is made of rubber or plastics having a suitable degree of elasticity, as mentioned previously, and the shape thereof is an L-shape. The blade 11, like the blade 1 shown in FIG. 2, is held by the holder portion $\mathbf{10}_1$ so that it bears against the photosensitive medium 1*a* in opposed relationship with the direction of rotation of the latter (the direction of arrow C). That is, the blade 11 is installed so that the angle of contact between the tangential line of the surface of the photosensitive medium 1*a* at the edge bearing point E and the blade 11 is an acute angle. The holding of the blade 11 by the holder portion $\mathbf{10}_1$ is accomplished by bonding all or any of three surfaces e, f and g of the blade 11 which bear against the holder portion $\mathbf{10}_1$ to the holder portion $\mathbf{10}_1$ by means of an adhesive agent or a both-side tape. The thickness $t_1$ of the held portion $\mathbf{11}_1$ of the blade 11 which is held by the holder portion $\mathbf{10}_1$ is such that when the blade 11 is sandwichedly held by the holder portion $\mathbf{10}_1$ or when the blade 11 is tightened and held against the holder portion $\mathbf{10}_1$ by means of screws or the like, no non-uniform force is transmitted to the fore end portion of the blade even if the tightening force to which the held portion $\mathbf{11}_1$ is subjected is non-uniform and that the held portion $\mathbf{11}_1$ is not liable to be deformed when the blade 11 is urged against the photosensitive medium 1*a*.

The blade 11 of the present embodiment has its fore end portion partly cut away and is of an L-shape in which the thickness $t_2$ of the fore end portion 11 thereof is smaller than the thickness $t_1$ of the held portion $\mathbf{11}_1$ thereof, and is such a thickness that the increase in the pressure in the vicinity of the held portion $\mathbf{11}_1$ of the thickness $t_1$ (free length $l_2$) is sufficiently lessened when the free length L from the side edge h to the fore end i of the holder portion $\mathbf{10}_1$ is reduced more than in the prior art. Thus, the free length $l_1$ of the thin fore end portion $\mathbf{11}_2$ itself is shortened, whereby even if the thickness $t_2$ is made small, the rigidity of the blade 11 will not be extremely weakened and the fore end portion $\mathbf{11}_2$ of the blade can be maintained urged against the photosensitive medium 1*a* with a desired pressure force. Further, in the case of the blade 11 of the present embodiment, when it bears against the photosensitive medium 1*a*, concentration of stress is dispersed over portions $Q_1$, $Q_2$ and $Q_3$ and thus, reversal of the blade is not liable to occur.

By such a construction, a cleaning performance equivalent to that of the prior art device has been made possible with a very compact device.

As a further specific example, cleaning was carried out with $t_2=1$ mm, $l_1=2$ mm, $l_2=2$ mm, $l_3=3$ mm and $t_1=2$ mm and by the use of rubber having Young's modulus of 52 kg/cm$^3$. When, for the purpose of comparison, cleaning was carried out by the use of a conventional blade in the form of a rectangular plate-like member formed of the same material and having a thickness of 2 mm and a free length of 16 mm, a cleaning performance equivalent to that of the prior art example could be obtained. In this case, the free length of the blade could be about $\frac{1}{4}$ of the prior art.

Figure 5:
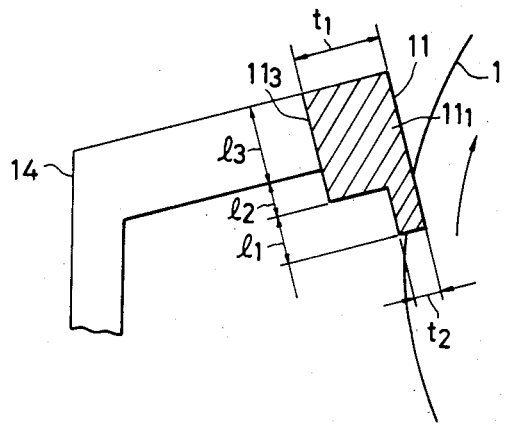
FIGS. 5 and 6 are side views of a cleaning blade to which another embodiment of the present invention is applied.

FIG. 5 is a fragmentary cross-sectional view showing another specific example based on the embodiment of the present invention.

In the example shown in FIG. 5, the held portion $\mathbf{11}_1$ of the elastic cleaning blade 11 is constructed so that it is held from the side opposite to the side on which the blade 11 bears against the photosensitive medium 1*a*. Reference numeral 14 designates a blade holder against which the side $\mathbf{11}_3$ of the blade 11 opposite from the photosensitive medium 1 is adhesively held.

Figure 6:
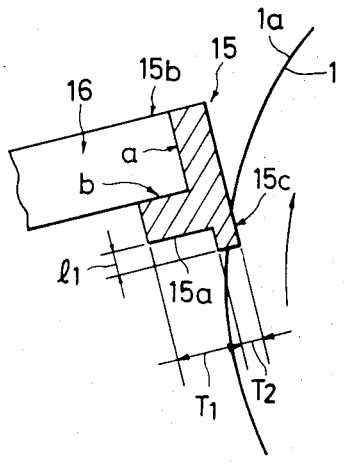

FIG. 6 shows a further embodiment of the present invention. This embodiment is a substantially T-shaped blade in which a cut-away portion 15*b* is provided in the held portion 15*a* of the elastic cleaning blade 15. The thickness $T_2$ of the fore end portion 15*c* of the blade 15 is made smaller than the thickness $T_1$ of the held portion 15*a*. A holder 16 bears against the cut-away portion 15*b* and is adhesively secured to the surfaces a and b of the blade 15. Again in this embodiment, even if the free length $l_1$ of the fore end portion 15*c* of the blade 15 is shortened to make the cleaning device compact, a suitable degree of force with which the blade 15 bears against the photosensitive medium 1*a* can be maintained.

Figure 7A:
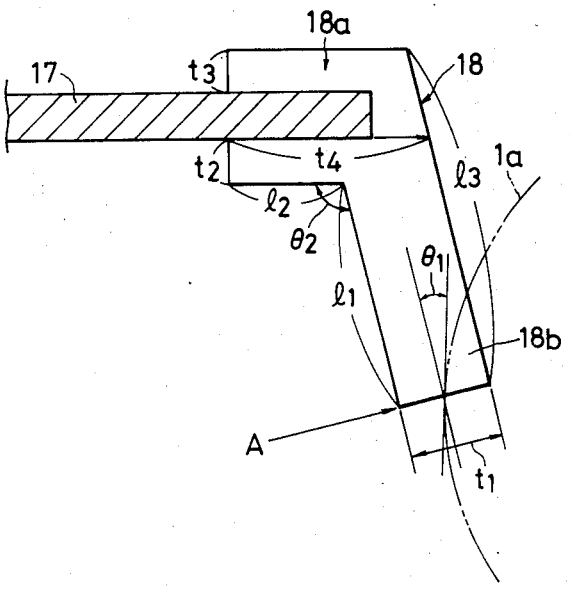
FIG. 7(A) is a side view of a cleaning blade to which still another embodiment of the present invention is applied.
Figure 7B:
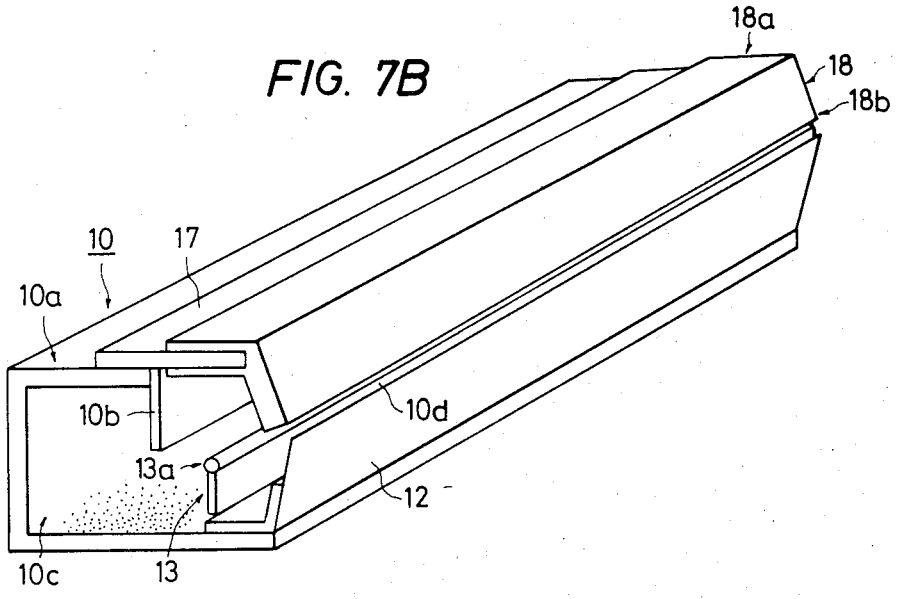
FIG. 7(B) is a perspective view of a cleaning device using the cleaning blade of FIG. 7(A).

Still another embodiment of the present invention is shown in FIGS. 7(A) and 7(B). FIG. 7(A) is a side view of a blade and FIG. 7(B) is a perspective view of a cleaning device. The blade is provided along substantially the entire width of the cleaning device so as to bear against the surface of the photosensitive medium to be cleaned over the entire width thereof.

This embodiment has been obtained by introducing a support plate 17 of aluminum, brass or like material and polyurethane rubber into a mold and molding them integrally, and then cutting the fore end A of a blade 18. The support plate 17 and the blade 18 have been molded integrally so that the angle $\theta_1$ at which the blade 18 bears against the photosensitive medium 1*a* is about 15° to about 35° when the cleaning device is mounted at a predetermined position in the copying apparatus body. In the present embodiment, the blade 18 is of a bent shape and the support plate 17 is fitted to the center of the holding portion 18*a* of the blade, and the thickness $t_1$ of the fore end portion 18*b* of the blade is made smaller than the thickness $t_4$ of the holding portion 18*a*. The angle $\theta_2$ formed between the holding portion 18*a* and the fore end portion 18*b* of the blade 18 is about 90° or more.

As a result of a test carried out with the blade of such a shape and of the following dimensions caused to bear against the photosensitive medium in opposed relationship with the direction of movement thereof at a bearing angle of about 20° to 30° and at a pressure of about 25g/cm per unit length, the blade offered no problem even when 10,000 copies were produced. The dimensions of the various portions of the blade were $t_1=1.5$ mm, $t_2=t_3=1.0$ mm, $t_4=3.5$ mm, $l_1=6.0$ mm, $l_2=2.0$ mm and $l_3=8.0$ mm and the hardness of the rubber of the blade was about 63° (JISA).

Figure 8:
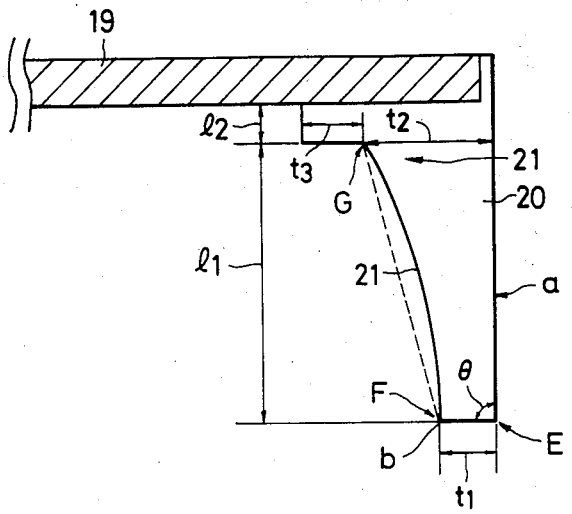
FIGS. 8 and 9 are side views of a cleaning blade to which yet still another embodiment of the present invention is applied.
Figure 9:
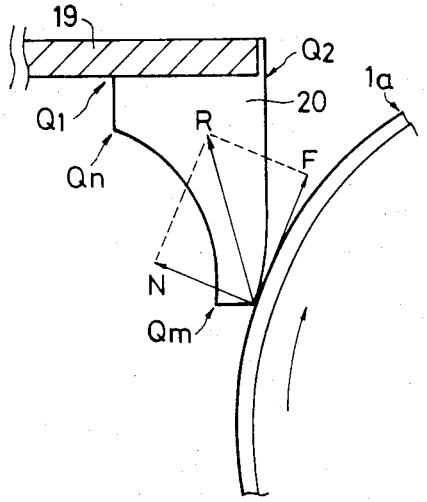

Yet still another embodiment is shown in FIGS. 8 and 9.

Again in this embodiment, as in the previous embodiment, a support plate 19 and a blade 20 have been molded integrally.

In this embodiment, the two surfaces a and b of the blade 20 which form an edge portion E adapted to bear against the photosensitive medium are planar and the angle $\theta$ formed between these two surfaces is about 90°. Also, this blade 20 has a curved surface 21 extending from the inner end surface F opposite to the edge E of the surface b toward the support plate 19, and the thickness $t_1$ of the portion between E and F is smallest and the thickness $t_2$ of the holding portion 21 adjacent to the support plate 19 is greatest. That is, this blade 20 has, on that side thereof opposite to the side of the blade 20 which bears against the surface of the photosensitive medium, a curved surface 21 extending away from the surface of the photosensitive medium toward the support plate 19.

When cleaning was carried out with a blade of dimensions $t_1=1.0$ mm, $t_2=2.0$ mm, $t_3=1.5$ mm, $l_1=6.0$ mm, and $l_2=0.5$ mm - 1.0 mm which was molded at a rubber hardness of about 62° (JISA) caused to bear against the photosensitive medium in opposed relationship with the direction of movement thereof at a pressure of 25 g/cm per unit length, the blade offered no problem even for 10,000 copies produced.

With this embodiment, even if the portion of the blade between G and F had no curvature but was, for example, straight, an equivalent test result could be obtained at the above-mentioned set pressure.

FIG. 9 shows the state of the force to which the blade 20 is subjected when the cleaning of the photosensitive medium is carried out by the use of the present embodiment.

In this embodiment, as shown, cleaning is carried out at the obtuse angle side whereat the blade 20 intersects the photosensitive medium 1*a*. Therefore, part of the combined drag R of the vertical drag N to which the blade 20 is subjected by the photosensitive medium 1*a* and the friction force F between the photosensitive medium 1*a* and the blade 20 is stored as an elastic strain and all the remainder of the combined drag R acts as an effective cleaning force. Thus, the cleaning performance can be enhanced as compared with a case where the blade is caused to bear against the photosensitive medium along the direction of movement thereof. Moreover, in the blade 20 of this embodiment, a variation in thickness is provided in the direction of the combined drag R and thus, although stress is applied to portions $Q_1$ and $Q_2$, the stress is not concentrated on these portions but is dispersed along portions $Q_n \rightarrow Q_m$ and thus, there is no changing point of reversal and reversal is not liable to occur.

Also, a knife edge structure is known as the configuration of the cleaner blade and a method of causing the edge thereof to bear against an image bearing member is known. However, in the manufacture of the blade, it is difficult to provide parallelism of the edges and the pressure at the fore end of the edge is weak and if the rubber is flexed to a predetermined pressure, there may be caused an inconvenience that no pressure is applied to the foremost end of the blade, or the fore end of the blade may be torn off when use is made of an image bearing member having a great coefficient of friction. The edge of this embodiment is comprised of two planar surfaces and the angle formed between these two surfaces is about 90°, and the edge has a thickness in the direciton of the perpendicular force component from the photosensitive medium and thus suffers very little from the problems peculiar to the knife edge.

The hardness (JISA) of the elastic blade may preferably be 30° or more, and most preferably 60° to 95° (JISA), but this is not restrictive. Also, the coupling between the blade and the support member may be accomplished by suitable means such as adhesive agent, integral molding, screws or rivets. Further, the blade may be attached to the cleaning housing or other suitable member.

As described above, the present invention provides a cleaning device which is made compact by reducing the size of the elastic cleaning blade and in which the blade is provided in opposed relationship with the surface to be cleaned to thereby obtain a sufficient cleaning performance.

What we claim is:

1. A cleaning device for cleaning a surface to be cleaned, comprising:

an elastic cleaning blade contacting the surface to be cleaned so as to clean said surface;

a support member supporting said elastic cleaning blade in such a manner that said cleaning blade contacts said surface to be cleaned while opposing a direction in which the surface to be cleaned moves; and receiving means for receiving objects removed by said elastic cleaning blade from the surface to be cleaned;

wherein said elastic cleaning blade includes a substantially rectangular fore end portion which contacts the surface to be cleaned and which has a thickness less than at where said blade is supported by said support member.

2. A cleaning device according to claim 1, wherein said support member and said elastic cleaning blade are integrally molded.

3. A cleaning device according to claim 1, wherein said supporting member and said elastic cleaning blade are adhesively coupled together.

4. A cleaning device according to claim 1, wherein said support member sandwiches said elastic cleaning blade.

5. A cleaning device according to claim 1, wherein said elastic cleaning blade sandwiches said support member.

6. A cleaning device for cleaning a surface to be cleaned, comprising:

an elastic cleaning blade contacting the surface to be cleaned so as to clean said surface, wherein said elastic cleaning blade is substantially L-shaped;

a support member supporting said elastic cleaning blade in such a manner that said cleaning blade contacts said surface to be cleaned while opposing a direction in which the surface to be cleaned moves; and receiving means for receiving objects removed by said elastic cleaning blade from the surface to be cleaned;

wherein said elastic cleaning blade is thinner at a side where it contacts the surface to be cleaned than at a side where it is supported by said support member.

7. A cleaning device for cleaning a surface to be cleaned, comprising:

an elastic cleaning blade contacting the surface to be cleaned so as to clean said surface, wherein said elastic cleaning blade is substantially T-shaped;

a support member supporting said elastic cleaning blade in such a manner that said cleaning blade contacts said surface to be cleaned while opposing a direction in which the surface to be cleaned moves; and receiving means for receiving objects removed by said elastic cleaning blade from the surface to be cleaned;

wherein said elastic cleaning blade is thinner at a side where it contacts the surface to be cleaned than at a side where it is supported by said support member.

8. A cleaning device for cleaning a surface to be cleaned, comprising:

an elastic cleaning blade contacting the surface to be cleaned so as to clean said surface;

a support member supporting said elastic cleaning blade in such a manner that said cleaning blade contacts said surface to be cleaned while opposing a direction in which the surface to be cleaned moves; and receiving means for receiving objects removed by said elastic cleaning blade from the surface to be cleaned;

wherein said elastic cleaning blade has a step at a reverse side with respect to the surface thereof facing the cleaned surface and wherein said surface of said cleaning blade facing said surface to be cleaned is flat when no pressure is applied thereon.

9. A cleaning device for cleaning a surface to be cleaned, having:

a support member;

an elastic cleaning blade supported by said support member such that said blade contacts said surface to be cleaned at a first side thereof while opposing a direction in which the surface to be cleaned moves, the thickness of the fore end portion of said blade being smaller than that of the portion of said blade which is adjacent to said support member, said elastic blade having, on a second side thereof opposite to said first side thereof which bears against the surface to be cleaned, a curved surface extending away from the surface to be cleaned from said fore end portion toward said support member.

10. A cleaning device for cleaning a surface to be cleaned, comprising:

an elastic cleaning blade contacting the surface to be cleaned so as to clean said surface;

a support member supporting said elastic cleaning blade in such a manner that said cleaning blade contacts said surface to be cleaned while opposing a direction in which the surface to be cleaned moves; and receiving means for receiving objects removed by said elastic cleaning blade from the surface to be cleaned;

wherein said elastic cleaning blade includes a fore end portion having a first surface facing the surface to be cleaned, a second surface which intersects said first surface to define an edge adapted to bear against said surface to be cleaned and a sloped surface at an opposite side with respect to said first surface so that said elastic cleaning blade is thicker where it is supported by said support member than at the edge where it contacts the surface to be cleaned.

* * * * *